US006261381B1

(12) United States Patent
Wojcik

(10) Patent No.: US 6,261,381 B1
(45) Date of Patent: Jul. 17, 2001

(54) COMPOSITION AND PROCESS FOR CLEANING INKS FROM VARIOUS SUBSTRATES INCLUDING PRINTING PLATES

(75) Inventor: Gerald Wojcik, Thomaston, CT (US)

(73) Assignee: MacDermid, Incorporated, Waterbury, CT (US)

( * ) Notice: Subject to any disclaimer, the term of this patent is extended or adjusted under 35 U.S.C. 154(b) by 0 days.

(21) Appl. No.: 09/710,976

(22) Filed: Nov. 9, 2000

(51) Int. Cl.[7] ..... B08B 3/04

(52) U.S. Cl. ..... 134/42; 134/2; 134/22.19; 134/36; 510/170; 510/171; 510/172; 510/174; 510/407; 510/421; 510/506; 510/437; 510/477; 510/488; 510/500

(58) Field of Search ..... 134/2, 22.19, 36, 134/42; 510/170, 171, 172, 174, 407, 421, 506, 437, 477, 488, 500

(56) References Cited

U.S. PATENT DOCUMENTS

| | | | | |
|---|---|---|---|---|
| 3,963,560 | * | 6/1976 | Mestetsky et al. | 162/5 |
| 4,836,950 | * | 6/1989 | Madsen et al. | 252/153 |
| 5,104,567 | | 4/1992 | Staehr | 252/174.17 |
| 5,340,493 | * | 8/1994 | Principato | 252/462 |
| 5,792,278 | | 8/1998 | Wojcik | 134/38 |
| 5,814,163 | | 9/1998 | Wojcik | 134/39 |
| 6,165,962 | * | 12/2000 | Kaler et al. | 510/365 |

OTHER PUBLICATIONS

RD 409059 A, Solvent Applications of 1,3–Dimethyl–L–Piperidone, 1,5–Dimethyl–2–Piperidone & Mixture Thereof, May 1998.*

* cited by examiner

*Primary Examiner*—Sharidan Carrillo
(74) *Attorney, Agent, or Firm*—Carmody & Torrance LLP

(57) ABSTRACT

A composition and process for cleaning inks and organic residues from various substrates utilizing dimethyl piperidone and other safe solvents is revealed. The composition and process are particularly useful in cleaning printing plates and printing apparatus.

4 Claims, No Drawings

COMPOSITION AND PROCESS FOR CLEANING INKS FROM VARIOUS SUBSTRATES INCLUDING PRINTING PLATES

FIELD OF THE INVENTION

The present invention relates to a relatively safe and environmentally friendly cleaning composition and process for use in the graphic art industry.

BACKGROUND OF THE INVENTION

Cleaning or washing printing inks and other organic residues from printing plates, rollers, and other machine parts within the graphics industry has been effected by a variety of means over the years. However, the cleaning liquids employed frequently contain dangerous substances, such as low boiling aromatic solvents, carcinogenic materials and other substances that entail considerable risks to the individuals handling these substances. In addition to safety risks, typical cleaning liquids in this regard can pose considerable environmental issues. In particular, the use of petroleum distillates or aromatic compounds such as xylene, toluene, or naphthalene-based agents is widespread. The significant health, safety and environmental dangers of these substances are well known. Such compounds are, in general, highly volatile and exhibit low flash points.

Because of the health hazards associated with these volatile solvents, various efforts have been made to produce cleaning solutions that are free of such solvents. U.S. Pat. No. 5,104,567 to Staehr, the teachings of which are incorporated herein by reference in their entirety, reveal some exemplary cleaning solutions which are free of solvents. Staehr proposes a solution of vegetable oil and an emulsifier as an ink cleaner. Further reference is made to U.S. Pat. Nos. 5,792,278 and 5,814,163, both to Wojcik, the teachings each of which are incorporated herein by reference in their entirety, reveal improved ink cleaning compositions.

It is an object of the present invention to provide an ink cleaning solution which is safer to handle and more environmentally friendly than cleaning solutions based upon volatile solvents, but which is also a more effective cleaning agent than previously taught solvent substitutes. These and other objects of this invention will be apparent to those skilled in the art upon reading the disclosure contained herein.

SUMMARY OF THE INVENTION

The present invention proposes a composition and process for cleaning inks, ink residues and other organic residues from printing plates, screens, rollers, various parts of printing presses, and other surfaces. The inventor herein has discovered that cleaning compositions comprising dimethyl piperidone are particularly useful in this regard. Preferably the dimethyl piperidone is combined in the cleaning composition with other safe solvents.

It has been discovered that cleaning compositions comprising dimethyl piperidone and/or mixtures of dimethyl piperidone with other safe solvents possess excellent cleaning properties, but are safer to handle and more environmentally friendly than previously known ink cleaning compositions.

DETAILED DESCRIPTION

The inventor herein has discussed that cleaning compositions comprising dimethyl piperidone and/or mixtures of dimethyl piperidone with other safe solvents are particularly useful in cleaning ink, ink residues, and other organic residues from printing plates, screens, rollers, various parts of printing presses and other surfaces.

Dimethyl piperidone also known as dimethyl gamma valerolactam is generally supplied as a racemic mixture of isomers. Generally, the 1,3 and 1,5 isomers dominate such mixtures. Dimethyl piperidone is generally supplied as an article of commerce containing from 64–71 weight percent 1,3-dimethyl-2-piperidone and from 29–36 weight percent 1,5-dimethyl-2-piperidone along with trace amounts of 3 methyl-2-piperidone and 5-methyl-2-piperidone. Such racemic mixtures are available from Dupont® of Wilmington, Del. As used in this application and in the claims, the word, dimethyl piperidone, shall mean all isomers thereof as well as racemic mixtures thereof. The concentration of dimethyl piperidone the cleaning composition may range from about 10 to 100 percent by weight but is preferably from about 20 to 80 percent by weight.

Preferably the cleaning composition also comprises at least one other safe solvent. Good choices in this regard include limonene (especially d-limonene), dipropylene glycol methyl ether, tetrahydrofurfural alcohol, dimethyl ester, dimethyl glutarate, benzyl alcohol, butyrolactone, n-methyl-2-pyrrolidone, dibasic ester, hydrocarbons, and mixtures of any of the foregoing. Of the foregoing d-limonene, dipropylene glycol methyl ether, n-methyl-2-pyrrolidone and butyrolactone are especially preferred as safe co-solvents to be mixed with the dimethyl piperidone in the proposed cleaning composition. Although the foregoing are preferred solvents, a wide variety of compatible solvents may be used in conjunction with the dimethyl piperidone. The concentration of these safe solvents in the cleaning composition, alone or as a mixture, may range from about 5 to 90 weight percent but is preferably from about 10 to 80 percent by weight.

Optionally surfactants or emulsifiers may be added to the cleaning composition. Preferably the surfactants are nonionic. If used, the concentration of surfactants in the cleaning composition is preferably between about 0.5 and 5 percent by weight. It may also be preferable to employ a mixture of surfactants depending upon the particular application of the cleaning composition. The addition of surfactants is particularly useful if it is important to make the cleaning composition water rinseable.

As indicated, the cleaning composition of this invention is particularly useful in cleaning ink, ink residues and other organic residues from a variety of surfaces, including printing apparatuses. The cleaning composition described herein is generally applied at room temperature using a cloth or similar equivalent means of contact.

This invention is further described in the following examples that are meant to further illustrate particular embodiments of the invention but are not meant to be limiting.

EXAMPLES 1–9

The following cleaning compositions were prepared using dimethyl piperidone:

| Component | Concentration (Wt. %) |
|---|---|
| Formulation #1: | |
| Dimethyl piperidone | 90.00% |
| d-limonene | 10.00% |
| Formulation #2: | |
| Dimethyl Piperidone | 80.00% |
| d-limonene | 10.00% |
| Dipropylene glycol methyl ether | 10.00% |
| Formulation #3: | |
| Dimethyl piperidone | 90.00% |
| Tetrahydrofurfural alcohol | 10.00% |
| Formulation #4: | |
| Dimethyl piperidone | 50.00% |
| Dimethyl ester | 50.00% |
| Formulation #5: | |
| Dimethyl piperidone | 20.00% |
| Tetrahydrofurfural alcohol | 20.00% |
| Dimethyl ester | 20.00% |
| y-Butyrolactone | 20.00% |
| Benzyl alcohol | 20.00% |
| Formulation #6: | |
| Dimethyl piperidone | 75.00% |
| N-Methyl-2-pyrrolidone | 25.00% |
| Formulation #7: | |
| Dimethyl piperidone | 80.00% |
| N-Methyl-2-pyrrolidone | 20.00% |
| Dipropylene glycol methyl ether | 10.00% |
| Formulation #8: | |
| Dimethyl piperidone | 80.00% |
| y-Butyrolactone | 20.00% |
| Formulation #9: | |
| Dimethyl piperidone | 50.00% |
| Dipropylene glycol methyl ether | 25.00% |
| y-Butyrolactone | 25.00% |

In each case the above noted formulations were utilized to clean various inks, ink residues, and other organic residues from various surfaces, including metal, rubber, plastic, ceramic and cured photopolymer.

The results were excellent, meaning that the composition effectively cleaned the surfaces without damaging the surfaces.

EXAMPLE 10

The following cleaning composition is prepared:

Formulation #10:

| Component | Concentration (Wt. %) |
|---|---|
| Dimethyl piperidone | 20.00% |
| Tetrahydrofurfural alcohol | 20.00.% |
| Dimethyl ester | 20.00% |
| Butyrolactone | 20.00% |
| Benzyl alcohol | 17.00% |
| Triton ® X-100* | 3.00% |

*A surfactant available from the Rhom & Haas Company

The resulting composition is water rinseable and leaves very little to no residue after rinsing with water, after being used to clean ink, ink residues and other organic residues from various surfaces without damaging the surfaces.

What is claimed is:

1. A process for cleaning inks and organic residues from a surface of a printing apparatus, said process comprising contacting the surface of the printing apparatus with a cleaning composition consisting of dimethyl piperidone and a material selected from the group consisting of d-limonene, dipropylene glycol methyl ether, n-methyl-2-pyrrolidone, butyrolactone, and mixtures of any of the foregoing.

2. A process according to claim 1 wherein the concentration of the material in the cleaning composition is from about 10 to 80 percent by weight.

3. A process for cleaning inks and organic residues from a surface of a printing apparatus, said process comprising contacting the surface of the printing apparatus with a cleaning composition consisting of dimethyl piperidone, a surfactant, and a material selected from the group consisting of d-limonene, dipropylene glycol methyl ether, n-methyl-2-pyrrolidone, butyrolactone, and mixtures of any of the foregoing.

4. A process according to claim 3 wherein the concentration of the material in the cleaning composition is from about 10 to 80 percent by weight.

* * * * *